US008796194B2

(12) United States Patent
Mutou et al.

(10) Patent No.: US 8,796,194 B2
(45) **Date of Patent: *Aug. 5, 2014**

(54) LUBRICANT COMPOSITION

(75) Inventors: Akio Mutou, Tokyo (JP); Akira Yaguchi, Tokyo (JP); Shigeki Matsui, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 55 days.

This patent is subject to a terminal disclaimer.

(21) Appl. No.: 13/392,189

(22) PCT Filed: Aug. 30, 2010

(86) PCT No.: PCT/JP2010/064698

§ 371 (c)(1),
(2), (4) Date: Feb. 24, 2012

(87) PCT Pub. No.: WO2011/027730

PCT Pub. Date: Mar. 10, 2011

(65) Prior Publication Data

US 2012/0157361 A1 Jun. 21, 2012

(30) Foreign Application Priority Data

Sep. 1, 2009 (JP) ..... 2009-201917

(51) Int. Cl.
*C10M 145/14* (2006.01)
*C10M 173/02* (2006.01)

(52) U.S. Cl.
USPC ..... 508/469; 508/472; 508/507

(58) Field of Classification Search
USPC ..... 508/469, 472, 507
See application file for complete search history.

(56) References Cited

U.S. PATENT DOCUMENTS

| | | | |
|---|---|---|---|
| 2,861,941 | A | 11/1958 | Jancosek et al. |
| 2,890,161 | A | 6/1959 | Brown et al. |
| 3,078,222 | A | 2/1963 | Henke et al. |
| 3,847,790 | A | 11/1974 | Putz |
| 4,021,357 | A | 5/1977 | Morduchowitz et al. |
| 4,867,894 | A | 9/1989 | Pennewiss et al. |
| 5,282,958 | A | 2/1994 | Santilli et al. |
| 5,362,378 | A | 11/1994 | Borghard et al. |
| 5,652,201 | A | 7/1997 | Papay et al. |
| 5,763,374 | A | 6/1998 | Sakai et al. |
| 5,955,405 | A | 9/1999 | Liesen et al. |
| 6,077,455 | A | 6/2000 | Bloch et al. |
| 6,090,989 | A | 7/2000 | Trewella et al. |
| 6,383,366 | B1 | 5/2002 | Riley et al. |
| 6,602,402 | B1 | 8/2003 | Benazzi et al. |
| 7,285,206 | B2 | 10/2007 | Germaine |
| 7,867,957 | B2 | 1/2011 | Matsui et al. |
| 2001/0056044 | A1 | 12/2001 | Kinker et al. |
| 2002/0119896 | A1 | 8/2002 | Yagishita et al. |
| 2003/0036488 | A1 | 2/2003 | Yuki et al. |
| 2003/0104955 | A1 | 6/2003 | Yuki et al. |
| 2003/0162673 | A1 | 8/2003 | Kurihara et al. |
| 2003/0226785 | A1 | 12/2003 | Murphy et al. |
| 2004/0045868 | A1 | 3/2004 | Germaine |
| 2004/0065588 | A1 | 4/2004 | Genetti et al. |
| 2004/0077509 | A1 | 4/2004 | Yuki et al. |
| 2004/0079675 | A1 | 4/2004 | Germaine et al. |
| 2004/0092409 | A1 | 5/2004 | Liesen |
| 2004/0099571 | A1 | 5/2004 | Germaine et al. |
| 2004/0108249 | A1 | 6/2004 | Cody et al. |
| 2004/0112792 | A1 | 6/2004 | Murphy et al. |
| 2004/0119046 | A1 | 6/2004 | Carey et al. |
| 2004/0129603 | A1 | 7/2004 | Fyfe et al. |
| 2004/0154957 | A1 | 8/2004 | Keeney et al. |
| 2004/0154958 | A1 | 8/2004 | Alexander et al. |
| 2004/0198616 | A1 | 10/2004 | Hirao et al. |
| 2004/0224860 | A1 | 11/2004 | Baba et al. |
| 2005/0077209 | A1 | 4/2005 | Miller et al. |
| 2005/0221998 | A1 | 10/2005 | Marumo et al. |
| 2006/0027486 | A1 | 2/2006 | Rosenbaum et al. |
| 2006/0052252 | A1 | 3/2006 | Wedlock |
| 2006/0172900 | A1 | 8/2006 | Yagishita et al. |
| 2006/0205610 | A1 | 9/2006 | Rosenbaum et al. |

(Continued)

FOREIGN PATENT DOCUMENTS

| | | |
|---|---|---|
| CA | 2682660 | 10/2008 |
| CN | 1279708 | 1/2001 |

(Continued)

OTHER PUBLICATIONS

Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.

Yozo Oshima et al., "Monomethylparaffins in n-Paraffins Adducted from Petroleum Fractions", Sekiyu Gakkaishi, vol. 18, No. 6, 1975, pp. 497-502, along with a partial English-language translation.

Notification of Information Provision issued with respect to Japanese Patent App. No. 2008-261079, mailed Mar. 12, 2013.

U.S. Appl. No. 13/375,365 to Matsui et al., filed Nov. 30, 2011.

English language translation and Japanese language International Search Report for PCT/JP2010/064698; Mailed Nov. 2, 2010.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The lubricating oil composition of the invention includes a lubricating base oil with a kinematic viscosity at 100° C. of 1-6 $mm^2/s$, a % $C_p$ of 70 or greater and a % $C_A$ of no greater than 2, and a viscosity index improver which, when added to the lubricating base oil, results in an A/B ratio of less than 3.2 and a C/B ratio of less than 1.5. A is the thickening effect on the kinematic viscosity at 100° C., B is the thickening effect on the HTHS viscosity at 150° C., and C is the thickening effect on the HTHS viscosity at 100° C.

5 Claims, No Drawings

(56) References Cited

U.S. PATENT DOCUMENTS

| | | | |
|---|---|---|---|
| 2007/0032392 | A1 | 2/2007 | Yokoyama et al. |
| 2007/0138032 | A1 | 6/2007 | Agarkov |
| 2007/0138052 | A1 | 6/2007 | Kobayashi et al. |
| 2007/0191239 | A1 | 8/2007 | Matsuoka et al. |
| 2007/0238627 | A1 | 10/2007 | Haire et al. |
| 2007/0287643 | A1 | 12/2007 | Matsui et al. |
| 2008/0015400 | A1 | 1/2008 | Matsui et al. |
| 2008/0029430 | A1 | 2/2008 | Loh et al. |
| 2008/0029431 | A1 | 2/2008 | Alexander et al. |
| 2008/0110799 | A1 | 5/2008 | Matsui et al. |
| 2008/0248981 | A1 | 10/2008 | Matsui et al. |
| 2009/0005278 | A1 | 1/2009 | Takeuchi et al. |
| 2009/0075852 | A1 | 3/2009 | Yagishita et al. |
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0042267 | A1 | 2/2011 | Hayasaka |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa et al. |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |
| 2012/0157361 | A1 | 6/2012 | Mutou et al. |

FOREIGN PATENT DOCUMENTS

| | | |
|---|---|---|
| CN | 1751115 | 3/2006 |
| CN | 1317368 C | 5/2007 |
| CN | 101065469 | 10/2007 |
| CN | 101213277 | 7/2008 |
| CN | 101426879 | 5/2009 |
| EP | 1 749 876 | 2/2007 |
| EP | 1 808 476 | 7/2007 |
| EP | 1 845 151 | 10/2007 |
| EP | 2 011 855 | 8/2008 |
| EP | 2 009 074 | 12/2008 |
| EP | 2 009 704 | 12/2008 |
| EP | 2009074 | 12/2008 |
| EP | 2 011 854 | 1/2009 |
| EP | 2 112 217 | 10/2009 |
| EP | 2135928 | 12/2009 |
| EP | 2 241 611 | 10/2010 |
| EP | 2264131 | 12/2010 |
| EP | 2264133 | 12/2010 |
| EP | 2 319 908 | 5/2011 |
| GB | 2407100 | 4/2005 |
| JP | S30-000624 | 2/1955 |
| JP | S31-003928 | 5/1956 |
| JP | S45-019183 | 7/1970 |
| JP | S48-025003 | 4/1973 |
| JP | 63-223094 | 9/1988 |
| JP | S63-309592 | 12/1988 |
| JP | 3-100099 | 4/1991 |
| JP | 4-30391 | 2/1992 |
| JP | 4-036391 | 2/1992 |
| JP | 4-68082 | 3/1992 |
| JP | 4-120193 | 4/1992 |
| JP | H5-508876 | 12/1993 |
| JP | 6-145258 | 5/1994 |
| JP | 06-306384 | 11/1994 |
| JP | 7-048421 | 2/1995 |
| JP | 7-062372 | 3/1995 |
| JP | 8-183988 | 7/1996 |
| JP | 8-302378 | 11/1996 |
| JP | 9-003463 | 1/1997 |
| JP | 2000-063439 | 2/2000 |
| JP | 2000-63877 | 2/2000 |
| JP | 2000-345170 | 12/2000 |
| JP | 2000-345171 | 12/2000 |
| JP | 2001-514301 | 9/2001 |
| JP | 2001-279278 | 10/2001 |
| JP | 2001-279287 | 10/2001 |
| JP | 2002-503754 | 2/2002 |
| JP | 2002-503755 | 2/2002 |
| JP | 2002-129182 | 5/2002 |
| JP | 2002-521499 | 7/2002 |
| JP | 2002-302687 | 10/2002 |
| JP | 2004-10799 | 1/2004 |
| JP | 2004-124080 | 4/2004 |
| JP | 2004-169029 | 6/2004 |
| JP | 2004-526831 | 9/2004 |
| JP | 2004-528426 | 9/2004 |
| JP | 2005-154760 | 6/2005 |
| JP | 2005-171186 | 6/2005 |
| JP | 2005-213447 | 8/2005 |
| JP | 2005-290238 | 10/2005 |
| JP | 2005-530902 | 10/2005 |
| JP | 2006-502297 | 1/2006 |
| JP | 2006-502298 | 1/2006 |
| JP | 2006-045277 | 2/2006 |
| JP | 2006-509899 | 3/2006 |
| JP | 2006-117851 | 5/2006 |
| JP | 2006-117853 | 5/2006 |
| JP | 2006-219642 | 8/2006 |
| JP | 2006-518395 | 8/2006 |
| JP | 2006-241436 | 9/2006 |
| JP | 2006-241437 | 9/2006 |
| JP | 2006-521416 | 9/2006 |
| JP | 2006-274209 | 10/2006 |
| JP | 2007-016172 | 1/2007 |
| JP | 2007-45850 | 2/2007 |
| JP | 2007-217494 | 8/2007 |
| JP | 2007-246659 | 9/2007 |
| JP | 2007-246661 | 9/2007 |
| JP | 2007-246662 | 9/2007 |
| JP | 2007-262239 | 10/2007 |
| JP | 2007-269885 | 10/2007 |
| JP | 2007-270059 | 10/2007 |
| JP | 2007-270062 | 10/2007 |
| JP | 2007-284635 | 11/2007 |
| JP | 2007-297528 | 11/2007 |
| JP | 2007-326963 | 12/2007 |
| JP | 2008-013281 | 1/2008 |
| JP | 2008-13681 | 1/2008 |
| JP | 2008-013684 | 1/2008 |
| JP | 2008-509244 | 3/2008 |
| JP | 2008-120908 | 5/2008 |
| JP | 2008-120909 | 5/2008 |
| JP | 2008-184569 | 8/2008 |
| JP | 2008-231189 | 10/2008 |
| JP | 2008-231190 | 10/2008 |
| JP | 2008-231191 | 10/2008 |
| JP | 2008-274236 | 11/2008 |
| JP | 2008-274237 | 11/2008 |
| JP | 2008-274238 | 11/2008 |
| JP | 2008-303344 | 12/2008 |
| JP | 2009-74068 | 4/2009 |
| JP | 2009-96925 | 5/2009 |
| JP | 2009-167278 | 7/2009 |
| JP | 2010-532805 | 10/2010 |
| WO | 96/03359 | 2/1996 |
| WO | 9603359 | 2/1996 |
| WO | 99/41334 | 8/1999 |
| WO | 02/070629 | 9/2002 |
| WO | 2005/037967 | 4/2005 |
| WO | 2005/090528 | 9/2005 |
| WO | 2006/043709 | 4/2006 |
| WO | 2007/001000 | 1/2007 |

(56) References Cited

FOREIGN PATENT DOCUMENTS

| | | |
|---|---|---|
| WO | 2007/105769 | 9/2007 |
| WO | 2007/114132 | 10/2007 |
| WO | 2007/114260 | 10/2007 |
| WO | 2007/116759 | 10/2007 |
| WO | 2007/119299 | 10/2007 |
| WO | 2007/123266 | 11/2007 |
| WO | 2007/133999 | 11/2007 |
| WO | 2008/072526 | 6/2008 |
| WO | 2008/093446 | 8/2008 |
| WO | 2008/123246 | 10/2008 |
| WO | 2008/123249 | 10/2008 |
| WO | 2009/007147 | 1/2009 |
| WO | 2009/072524 | 6/2009 |
| WO | 2009/090921 | 7/2009 |
| WO | 2009/119505 | 10/2009 |
| WO | 2010/041689 | 4/2010 |
| WO | 2010/041692 | 4/2010 |

OTHER PUBLICATIONS

English language translation of International Preliminary Report on Patentability for PCT/JP2010/064698; Mailed Mar. 29, 2012.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126.5, mailed May 23, 2012.
Search report from E.P.O. that issued with respect to European Patent Application No. 09819223.0, mailed May 23, 2012.
Notification of Information Provision issued with respect to Japanese Patent Application No. 2009-135369, mailed May 29, 2012.
Notification of Information Provision issued with respect to Japanese Patent Application No. 2009-135444, mailed Jun. 19, 2012.
Office Action issued with respect to Chinese Patent Application No. 201080024832.7, mailed Dec. 12, 2012.
Office Action issued with respect to U.S. Appl. No. 12/812,524, mailed Jan. 22, 2013.
Office Action issued with respect to Chinese Patent Application No. 200980110123.8, mailed Apr. 1, 2013.
Schiessler et al., "Urea and Thiourea Adduction of $C_5$-$C_{42}$-Hydrocarbons", *Journal of the American Chemical Society*, vol. 74, No. 7, pp. 1720-1723, Apr. 5, 1952.
Notification of Information Provision issued with respect to Japanese Patent App. No. 2008-006024, mailed May 14, 2013.
E.P.O. Office action that issued with respect to European Patent Application No. 09723908.1, mailed Mar. 2, 2012.
English-language translation of International Preliminary Report on Patentability for PCT/JP2009/067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Jan. 26, 2012.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
International Search Report for PCT/JP2009/067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
International Search Report for PCT/JP2010/059196, mailed Aug. 31, 2010.
J.P.O Notice of Information Provision issued with respect to Japanese Patent Application No. 2008-078224, mailed May 15, 2012.
E.P.O Search Report issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and l-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Office Action issued with respect to U.S. Appl. No. 12/812,524, mailed Aug. 28, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Office Action issued with respect to U.S. Appl. No. 13/122,828, mailed Feb. 28, 2013.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. WO0201003649, mailed Aug. 23, 2012.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Office Action issued with respect to Japanese Patent Application No. 2008-006024, mailed Dec. 4, 2012.
Office Action issued with respect to U.S. Appl. No. 12/934,374, mailed Mar. 25, 2013.
Office Action issued with respect to U.S. Appl. No. 13/122,622, mailed Mar. 22, 2013.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
Search Report issued with respect to European Patent Application No. 10783230.5, mailed Feb. 11, 2013.

(56) References Cited

OTHER PUBLICATIONS

Search Report issued with respect to European Patent Application No. 12008549.3, mailed Feb. 11, 2013.

Japanese Office Action issued with respect to Japanese Patent Application No. 2009-135369, dated Jul. 16, 2013.

Japanese Office Action issued with respect to Japanese Patent Application No. 2008-261079, dated May 21, 2013.

Japanese Office Action issued with respect to Japanese Patent Application No. 2008-261070, dated Jul. 2, 2013.

LUBRICANT COMPOSITION

TECHNICAL FIELD

The present invention relates to a lubricating oil composition.

BACKGROUND ART

Lubricating oils have been used in the past in internal combustion engines, gearboxes and other mechanical devices to promote smoother functioning. Internal combustion engine lubricating oils (engine oils), in particular, must exhibit a high level of performance under the high-performance, high-output and harsh operating conditions of internal combustion engines. Various additives such as anti-wear agents, metal cleaning agents, non-ash powders and antioxidants are therefore added to conventional engine oils to meet such performance demands. (See Patent documents 1-3, for example.) In addition, the fuel efficiency performance required of lubricating oils has continued to increase in recent years, and this has led to application of various high-viscosity-index base oils or friction modifiers (see Patent document 4, for example).

CITATION LIST

Patent Literature

[Patent document 1] Japanese Unexamined Patent Application Publication No. 2001-279287

[Patent document 2] Japanese Unexamined Patent Application Publication No. 2002-129182

[Patent document 3] Japanese Unexamined Patent Application Publication HEI No. 08-302378

[Patent document 4] Japanese Unexamined Patent Application Publication HEI No. 06-306384

SUMMARY OF INVENTION

Technical Problem

Conventional lubricating oils, however, cannot necessarily be considered adequate in terms of fuel efficiency.

For example, one common method for achieving fuel efficiency involves reducing the kinematic viscosity of the lubricating oil and increasing the viscosity index (multigrading by a combination of a low-viscosity base oil and a viscosity index improver). With such a method, however, the reduction in viscosity of the lubricating oil or the base oil composing it can reduce the lubricating performance under severe lubrication conditions (high-temperature, high-shear conditions), resulting in wear and seizing, as well as leading to problems such as fatigue fracture. In other words, with conventional lubricating oils it is difficult to impart sufficient fuel efficiency while maintaining practical performance in other ways such as durability.

Furthermore, while it is effective to maintain the HTHS viscosity at 150° C. (the "HTHS viscosity" is also known as "high-temperature high-shear viscosity") and lower the 40° C. kinematic viscosity, the kinematic viscosity at 100° C. and the HTHS viscosity at 100° C., in order to prevent the aforementioned inconveniences and impart fuel efficiency while maintaining durability, it has been extremely difficult to satisfy all of these conditions with conventional lubricating oils.

The present invention has been accomplished in light of these circumstances, and its object is to provide a lubricating oil composition maintaining the HTHS viscosity at 150° C., while having a sufficiently low 40° C. kinematic viscosity, kinematic viscosity at 100° C. and HTHS viscosity at 100° C.

Solution to Problem

In order to solve the problems described above, the invention provides a lubricating oil composition comprising a lubricating base oil having a kinematic viscosity at 100° C. of 1-6 $mm^2/s$, a % $C_p$ value of 70 or greater and a % $C_A$ value of no greater than 2, and a viscosity index improver which, when added to the lubricating base oil, results in an A/B ratio of less than 3.2 between the thickening effect A on the kinematic viscosity at 100° C. represented by the following formula (1) and the thickening effect B on the HTHS viscosity at 150° C. represented by the following formula (2), and a C/B ratio of less than 1.5 between the thickening effect C on the HTHS viscosity at 100° C. represented by the following formula (3) and the thickening effect B on the HTHS viscosity at 150° C. represented by the following formula (2).

$$A=X-X_0 \quad (1)$$

[In formula (1), A represents the thickening effect on the kinematic viscosity at 100° C., X represents the kinematic viscosity at 100° C. of a mixture of the lubricating base oil and the viscosity index improver at 3% by mass (unit: $mm^2/s$), and $X_0$ represents the kinematic viscosity at 100° C. of the lubricating base oil (units: $mm^2/s$).]

$$B=Y-Y_0 \quad (2)$$

[In formula (2), B represents the thickening effect on the HTHS viscosity at 150° C., Y represents the HTHS viscosity at 150° C. of a mixture of the lubricating base oil and the viscosity index improver at 3% by mass (unit: mPa·s), and $Y_0$ represents the HTHS viscosity at 150° C. of the lubricating base oil (units: mPa·s).]

$$C=Z-Z_0 \quad (3)$$

[In formula (3), C represents the thickening effect on the HTHS viscosity at 100° C., Z represents the HTHS viscosity at 100° C. of a mixture of the lubricating base oil and the viscosity index improver at 3% by mass (unit: mPa·s), and $Z_0$ represents the HTHS viscosity at 100° C. of the lubricating base oil (units: mPa·s).]

The "kinematic viscosity at 100° C." according to the invention is the kinematic viscosity at 100° C. measured according to ASTM D-445. The "% $C_p$" and "% $C_A$" values are, respectively, the percentage of the number of paraffinic carbons with respect to the total number of carbons and the percentage of the number of aromatic carbons with respect to the total number of carbons, as determined by methods according to ASTM D 3238-85 (n-d-M ring analysis). The "HTHS viscosity at 150° C." is the high-temperature high-shear viscosity at 150° C. according to ASTM D4683, and the "HTHS viscosity at 100° C." is the high-temperature high-shear viscosity at 100° C. according to ASTM D4683. Also, "PSSI" stands for the "Permanent Shear Stability Index" of the polymer, which is calculated according to ASTM D 6022-01 (Standard Practice for Calculation of Permanent Shear Stability Index) based on data measured according to ASTM D 6278-02 (Test Method for Shear Stability of Polymer Containing Fluids Using a European Diesel Injector Apparatus).

The A/B ratio between the thickening effect A on the kinematic viscosity at 100° C. represented by formula (1) and the thickening effect B on the HTHS viscosity at 150° C. represented by formula (2) is an index of the fuel efficiency, and a viscosity index improver with a high A/B ratio can potentially interfere with adequate fuel efficiency performance due to a poor viscosity-temperature characteristic, in cases where it is desired to maintain the HTHS viscosity at 150° C.

Also, the C/13 ratio between the thickening effect C on the HTHS viscosity at 100° C. represented by formula (3) and the thickening effect B on the HTHS viscosity at 150° C. represented by formula (2) is an index of the fuel efficiency performance, and a viscosity index improver with a high C/B ratio can also potentially interfere with adequate fuel efficiency performance due to a poor viscosity-temperature characteristic, in cases where it is desired to maintain the HTHS viscosity at 150° C.

The invention has been accomplished on the basis of this knowledge, and it allows a lubricating oil composition with sufficiently low 40° C. kinematic viscosity, kinematic viscosity at 100° C. and HTHS viscosity at 100° C. to be obtained, while maintaining HTHS viscosity at 150° C., by comprising the lubricating base oil specified above, and a viscosity index improver with an A/B ratio of less than 3.2 and a C/B ratio of less than 1.5.

According to the invention, the viscosity index improver is preferably a viscosity index improver having a D/B ratio of less than 10, between the thickening effect D on the 40° C. kinematic viscosity represented by the following formula (4) and the thickening effect B on the HTHS viscosity at 150° C. represented by formula (2) above. By using a viscosity index improver with a D/B ratio of less than 10, it is possible to lower the 40° C. kinematic viscosity while maintaining the HTHS viscosity at 150° C., thereby improving the fuel efficiency performance.

$$D=W-W_0 \quad (4)$$

[In formula (4), D represents the thickening effect on the 40° C. kinematic viscosity, W represents the 40° C. kinematic viscosity of a mixture of the lubricating base oil and the viscosity index improver at 3% by mass (unit: $mm^2/s$), and $W_0$ represents the 40° C. kinematic viscosity of the lubricating base oil (units: $mm^2/s$).]

The viscosity index improver is preferably a polymethacrylate with a PSSI of no greater than 30.

The lubricating oil composition of the invention also preferably has a kinematic viscosity at 100° C. of 5.6-9 $mm^2/s$, a HTHS viscosity at 150° C. of 2.6-2.9 mPa·s and a viscosity index of 150 or greater.

Advantageous Effects of Invention

Thus, it is possible to according to the invention to provide a lubricating oil composition that maintains its HTHS viscosity at 150° C. while having a sufficiently low 40° C. kinematic viscosity, kinematic viscosity at 100° C. and HTHS viscosity at 100° C. For example, with a lubricating oil composition of the invention it is possible to exhibit adequate fuel efficiency while maintaining a desired value for the HTHS viscosity at 150° C. (2.9 mPa·s or greater, for 0W-30 or 5W-30 SAE viscosity grade oils), without using a synthetic oil such as a poly-α-olefin-based base oil or esteric base oil, or a low-viscosity mineral base oil.

DESCRIPTION OF EMBODIMENTS

A preferred embodiment of the invention will now be described in detail.

The lubricating oil composition of the invention employs a lubricating base oil (hereunder referred to as "lubricating base oil of the invention") with a kinematic viscosity at 100° C. of 1-6 $mm^2/s$, a % $C_p$ of 70 or greater and a % $C_A$ or no greater than 2.

The lubricating base oil of the invention is not particularly restricted so long as it has a kinematic viscosity at 100° C., % $C_p$ and % $C_A$ satisfying the aforementioned conditions. Specifically, there may be mentioned purified paraffinic mineral oils produced by subjecting a lube-oil distillate obtained by atmospheric distillation and/or vacuum distillation of crude oil to a single treatment or two or more treatments, selected from among refining treatments such as solvent deasphalting, solvent extraction, hydrocracking, solvent dewaxing, catalytic dewaxing, hydrorefining, sulfuric acid cleaning and white clay treatment, or normal-paraffinic base oils, isoparaffinic base oils and the like, whose kinematic viscosity at 100° C., % $C_p$ and % $C_A$ satisfy the aforementioned conditions.

As a preferred example for the lubricating base oil of the invention there may be mentioned a base oil obtained by using one of the base oils (1)-(8) mentioned below as the raw material and purifying this stock oil and/or the lube-oil distillate recovered from the stock oil by a prescribed refining process, and recovering the lube-oil distillate.

(1) Distilled oil from atmospheric distillation of a paraffin-based crude oil and/or mixed-base crude oil.

(2) Distilled oil from vacuum distillation of atmospheric distillation residue oil from paraffin-based crude oil and/or mixed-base crude oil (WVGO).

(3) Wax obtained by a lubricating oil dewaxing step (slack wax or the like) and/or synthetic wax obtained by a gas-to-liquid (GTL) process (Fischer-Tropsch wax, GTL wax or the like).

(4) Blended oil comprising one or more oils selected from among base oils (1)-(3) and/or mild-hydrocracked oil obtained from the blended oil.

(5) Blended oil comprising two or more selected from among base oils (1)-(4).

(6) Deasphalted oil (DAO) from base oil (1), (2), (3), (4) or (5).

(7) Mild-hydrocracked oil (MHC) obtained from base oil (6).

(8) Blended oil comprising two or more selected from among base oils (1)-(7).

The prescribed refining process described above is preferably hydrorefining such as hydrocracking or hydrofinishing; solvent refining such as furfural solvent extraction; dewaxing such as solvent dewaxing or catalytic dewaxing; white clay refining with acidic white clay or active white clay, or chemical (acid or alkali) washing such as sulfuric acid treatment or caustic soda washing. According to the invention, any one of these refining processes may be used alone, or a combination of two or more thereof may be used in combination. When a combination of two or more refining processes is used, their order is not particularly restricted and it may be selected as appropriate.

The lubricating base oil of the invention is most preferably one of the following base oils (9) or (10) obtained by the prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.

(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

The kinematic viscosity at 100° C. of the lubricating base oil of the invention must be no greater than 6 $mm^2/s$, and it is preferably no greater than 5.7 $mm^2/s$, more preferably no greater than 5.5 $mm^2/s$, even more preferably no greater than 5.2 $mm^2/s$, particularly preferably no greater than 5.0 $mm^2/s$ and most preferably no greater than 4.5 $mm^2/s$. On the other hand, the kinematic viscosity at 100° C. must also be 1 $mm^2/s$ or greater, and is preferably 1.5 $mm^2/s$ or greater, more preferably 2 $mm^2/s$ or greater, even more preferably 2.5 $mm^2/s$ or greater, yet more preferably 3 $mm^2/s$ or greater and most preferably 3.5 $mm^2/s$ or greater. If the kinematic viscosity at 100° C. of the lubricating base oil exceeds 6 $mm^2/s$, the low-temperature viscosity characteristic may be impaired and sufficient fuel efficiency may not be obtained, while if it is less than 1 $mm^2/s$, oil film formation at the lubricated sections will be inadequate, resulting in inferior lubricity and potentially large evaporation loss of the lubricating oil composition.

The 40° C. kinematic viscosity of the lubricating base oil of the invention is also preferably no greater than 50 $mm^2/s$, more preferably no greater than 45 $mm^2/s$, even more preferably no greater than 40 $mm^2/s$, yet more preferably no greater than 35 $mm^2/s$ and most preferably no greater than 30 $mm^2/s$. On the other hand, the 40° C. kinematic viscosity is preferably 6.0 $mm^2/s$ or greater, more preferably 8.0 $mm^2/s$ or greater, even more preferably 12 $mm^2/s$ or greater, yet more preferably 14 $mm^2/s$ or greater and most preferably 15 $mm^2/s$ or greater. If the 40° C. kinematic viscosity of the lubricating base oil exceeds 50 $mm^2/s$, the low-temperature viscosity characteristic may be impaired and sufficient fuel efficiency may not be obtained, while if it is less than 6.0 $mm^2/s$, oil film formation at the lubricated sections will be inadequate, resulting in inferior lubricity and potentially large evaporation loss of the lubricating oil composition. According to the invention, a lube-oil distillate having a 40° C. kinematic viscosity in one of the following ranges is preferably used after fractionation by distillation or the like.

The viscosity index of the lubricating base oil of the invention is preferably 120 or greater, more preferably 130 or greater, even more preferably 135 or greater and most preferably 140 or greater. A viscosity index below these lower limits will not only impair the viscosity-temperature characteristic, heat and oxidation stability and resistance to volatilization, but will also tend to increase the frictional coefficient and potentially lower the anti-wear property.

The viscosity index for the purpose of the invention is the viscosity index measured according to JIS K 2283-1993.

The 15° C. density ($\rho_{15}$) of the lubricating base oil of the invention will depend on the viscosity grade of the lubricating base oil, but it is preferably no greater than the value of $\rho$ represented by the following formula (A), i.e., $\rho_{15} \leq \rho$.

$$\rho = 0.0025 \times X_0 + 0.816 \quad \text{(A)}$$

[In this formula, $X_0$ represents the kinematic viscosity at 100° C. ($mm^2/s$) of the lubricating base oil.]

If $\rho_{15} > \rho$, the viscosity-temperature characteristic and heat and oxidation stability, as well as the resistance to volatilization and the low-temperature viscosity characteristic, will tend to be lowered, thus potentially impairing the fuel efficiency. In addition, the efficacy of additives included in the lubricating base oil may be reduced.

Specifically, the density at 15° C. ($\rho_{15}$) of the lubricating base oil of the invention is preferably no greater than 0.860, more preferably no greater than 0.850, even more preferably no greater than 0.840 and most preferably no greater than 0.822.

The density at 15° C. for the purpose of the invention is the density measured at 15° C. according to JIS K 2249-1995.

The pour point of the lubricating base oil of the invention will depend on the viscosity grade of the lubricating base oil, and for example, it is preferably no higher than −10° C., more preferably no higher than −12.5° C. and even more preferably no higher than −15° C. If the pour point exceeds the upper limit specified above, the low-temperature flow properties of a lubricating oil employing the lubricating base oil will tend to be reduced. The pour point for the purpose of the invention is the pour point measured according to JIS K 2269-1987.

The aniline point (AP (° C.)) of the lubricating base oil of the invention will also depend on the viscosity grade of the lubricating base oil, but it is preferably greater than or equal to the value of $AP_0$ as represented by the following formula (B), i.e., $AP \geq AP_0$.

$$AP_0 = 4.3 \times X_0 + 100 \quad \text{(B)}$$

[In formula (B), $X_0$ represents the kinematic viscosity at 100° C. ($mm^2/s$) of the lubricating base oil.]

If $AP < AP_0$, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

The value of AP for the lubricating base oil of the invention is preferably 108° C. or higher, more preferably 119° C. or higher and even more preferably 128° C. or higher. The aniline point for the purpose of the invention is the aniline point measured according to JIS K 2256-1985.

The iodine value of the lubricating base oil of the invention is preferably no greater than 3, more preferably no greater than 2, even more preferably no greater than 1, yet more preferably no greater than 0.9 and most preferably no greater than 0.8. Although the value may be less than 0.01, in consideration of the fact that this does not produce any further significant effect and is uneconomical, the value is preferably 0.001 or greater, more preferably 0.01 or greater, even more preferably 0.03 or greater and most preferably 0.05 or greater. Limiting the iodine value of the lubricating base oil to no greater than 3 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refilling process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of the invention is preferably no greater than 100 ppm by mass, more preferably no greater than 50 ppm by mass, even more preferably no greater than 10 ppm by mass and especially no greater than 5 ppm by mass.

The nitrogen content in the lubricating base oil of the invention is not particularly restricted, but is preferably no greater than 7 ppm by mass, more preferably no greater than 5 ppm by mass and even more preferably no greater than 3 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The % $C_p$ value of the lubricating base oil of the invention must be 70 or greater, and it is preferably 80 or greater, more preferably 85 or greater, even more preferably 87 or greater and most preferably 90 or greater. It is also preferably no greater than 99, more preferably no greater than 96, even more preferably no greater than 95 and most preferably no greater than 94. If the % $C_p$ value of the lubricating base oil is less than the aforementioned lower limit, the viscosity-temperature characteristic and/or the heat and oxidation stability will tend to be reduced, while the efficacy of additives when added to the lubricating base oil will also tend to be reduced. If the % $C_p$ value of the lubricating base oil is greater than the aforementioned upper limit, on the other hand, the low-temperature flow property will tend to be impaired and the additive solubility will tend to be lower.

The % $C_A$ value of the lubricating base oil of the invention must be no greater than 2, and is more preferably no greater than 1.5, even more preferably no greater than 1, yet more preferably no greater than 0.8 and most preferably no greater than 0.5. If the % $C_A$ value of the lubricating base oil exceeds the aforementioned upper limit, the viscosity-temperature characteristic and/or the heat and oxidation stability will tend to be reduced.

The % $C_N$ value of the lubricating base oil of the invention is preferably no greater than 30, more preferably 4-25, even more preferably 5-13 and most preferably 5-8. If the % $C_N$ value of the lubricating base oil exceeds the aforementioned upper limit, the viscosity-temperature characteristic, heat and oxidation stability and frictional properties will tend to be reduced. If % $C_N$ is less than the aforementioned lower limit, the additive solubility will tend to be lower. The "% $C_N$" value is the percentage of the number of naphthenic carbons with respect to the total number of carbons, as determined by methods according to ASTM D 3238-85 (n-d-M ring analysis).

The aromatic content in the lubricating base oil of the invention is not particularly restricted so long as the kinematic viscosity at 100° C., %; and % $C_A$ values satisfy the conditions specified above, but it is preferably 90% by mass or greater, more preferably 95% by mass or greater and even more preferably 99% by mass or greater based on the total weight of the lubricating base oil, while the proportion of cyclic saturated components of the saturated components is preferably no greater than 40% by mass, more preferably no greater than 35% by mass, even more preferably no greater than 30% by mass, yet more preferably no greater than 25% by mass and most preferably no greater than 21% by mass. The proportion of cyclic saturated components among the saturated components is also preferably 5% by mass or greater and more preferably 10% by mass or greater. If the saturated component content and proportion of cyclic saturated components among the saturated components both satisfy these respective conditions, it will be possible to improve the viscosity-temperature characteristic and heat and oxidation stability, while additives added to the lubricating base oil will be kept in a sufficiently stable dissolved state in the lubricating base oil so that the functions of the additives can be exhibited at a higher level. According to the invention it is also possible to improve the frictional properties of the lubricating base oil itself, and thus result in a greater friction reducing effect and therefore increased energy savings. The "saturated components" for the purpose of the invention are measured by the method of ASTM D 2007-93.

The aromatic content in the lubricating base oil of the invention is not particularly restricted so long as the kinematic viscosity at 100° C., % $C_p$ and % $C_A$ values satisfy the conditions specified above, but it is preferably no greater than 5% by mass, more preferably no greater than 4% by mass, even more preferably no greater than 3% by mass and most preferably no greater than 2% by mass, and also preferably 0.1% by mass or greater, more preferably 0.5% by mass or greater, even more preferably 1% by mass or greater and most preferably 1.5% by mass or greater, based on the total weight of the lubricating base oil. If the aromatic content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content above the aforementioned lower limit.

The aromatic content, according to the invention, is the value measured according to ASTM D 2007-93.

The lubricating oil composition of the invention may employ a lubricating base oil according to the invention alone, or the lubricating base oil of the invention may be combined with one or more other lubricating base oils. When the lubricating base oil of the invention is combined with another lubricating base oil, the proportion of the lubricating base oil of the invention of the total mixed base oil is preferably at least 30% by mass, more preferably at least 50% by mass and even more preferably at least 70% by mass.

There are no particular restrictions on the other lubricating base oil used in combination with the lubricating base oil of the invention, and as examples of mineral base oils there may be mentioned solvent refined mineral oils, hydrocracked mineral oil, hydrorefined mineral oils and solvent dewaxed base oils having kinematic viscosities at 100° C. of 1-100 $mm^2/s$ and % $C_p$ and % $C_A$ values that do not satisfy the aforementioned conditions.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, which have kinematic viscosities at 100° C. that do not satisfy the conditions specified above, and poly-α-olefins are preferred among these. As typical poly-α-olefins there may be mentioned C2-32 and preferably C6-16 α-olefin oligomers or co-oligomers (1-octene oligomers, decene oligomers, ethylene-propylene co-oligomers and the like), and their hydrogenated forms.

The lubricating oil composition of the invention comprises, in addition to a lubricating base oil according to the invention as described above, also a viscosity index improver which results in an A/B ratio of less than 3.2 between the thickening effect A on the kinematic viscosity at 100° C. represented by the following formula (1) and the thickening effect B on the HTHS viscosity at 150° C. represented by the following formula (2), and a C/B ratio of less than 1.5 between the thickening effect C on the HTHS viscosity at 100° C. represented by the following formula (3) and the thickening effect B on the HTHS viscosity at 150° C. represented by the following formula (2).

$$A=X-X_0 \quad (1)$$

[In formula (1), A represents the thickening effect on the kinematic viscosity at 100° C., X represents the kinematic viscosity at 100° C. of a mixture of the lubricating base oil and the viscosity index improver at 3% by mass (unit: $mm^2/s$), and $X_0$ represents the kinematic viscosity at 100° C. of the lubricating base oil (units: $mm^2/s$).]

$$B=Y-Y_0 \quad (2)$$

[In formula (2), B represents the thickening effect on the HTHS viscosity at 150° C., Y represents the HTHS viscosity at 150° C. of a mixture of the lubricating base oil and the viscosity index improver at 3% by mass (unit: mPa·s), and $Y_0$ represents the HTHS viscosity at 150° C. of the lubricating base oil (units: mPa·s).]

$$C=Z-Z_0 \quad (3)$$

[In formula (3), C represents the thickening effect on the HTHS viscosity at 100° C., Z represents the HTHS viscosity at 100° C. of a mixture of the lubricating base oil and the viscosity index improver at 3% by mass (unit: mPa·s), and $Z_0$ represents the HTHS viscosity at 100° C. of the lubricating base oil (units: mPa·s).]

The ratio of A, B and C as the thickening effects of the viscosity index improver can be determined by measuring the kinematic viscosities at 100° C. $X_0$, X, the HTHS viscosities at 150° C. $Y_0$, Y and the HTHS viscosities at 100° C. $Z_0$, Z before and after addition of the viscosity index improver to the lubricating base oil of the invention at 3% by mass, and calculating the differences $X-X_0$, $Y-Y_0$ and $Z-Z_0$.

The A/B ratio of the thickening effect of the viscosity index improver must be less than 3.2 as mentioned above, and it is preferably no greater than 3.15, more preferably no greater than 3.10 and most preferably no greater than 3.05.

The C/B ratio of the thickening effect of the viscosity index improver must be less than 1.5 as mentioned above, and it is preferably no greater than 1.45, more preferably no greater than 1.40 and especially preferably no greater than 1.35.

The viscosity index improver used in the lubricating oil composition of the invention preferably has a D/B ratio of less than 10.0, more preferably no greater than 9.0, even more preferably no greater than 8.0 and most preferably no greater than 7.0, between the thickening effect D on the kinematic viscosity at 40° C. represented by the following formula (4) and the thickening effect B on the HTHS viscosity at 150° C. represented by formula (2) above.

$$D=W-W_0 \quad (4)$$

[In formula (4), D represents the thickening effect on the kinematic viscosity at 40° C., W represents the kinematic viscosity at 40° C. of a mixture of the lubricating base oil and the viscosity index improver at 3% by mass (unit: $mm^2/s$), and $W_0$ represents the kinematic viscosity at 40° C. of the lubricating base oil (units: $mm^2/s$).]

The PSSI (Permanent Shear Stability Index) of the viscosity index improver is preferably no greater than 30, more preferably no greater than 20, even more preferably no greater than 10, yet more preferably no greater than 8 and most preferably no greater than 6. The lower limit for the PSSI of the viscosity index improver (A) is preferably 1 or greater and more preferably 3 or greater. If the PSSI is greater than 30 the shear stability will be impaired, and it will therefore be necessary to increase the initial kinematic viscosity, potentially resulting in poor fuel efficiency. If the PSSI is less than 1, not only will the viscosity index-improving effect be low when it is dissolved in the lubricating base oil, and the fuel efficiency and low-temperature viscosity characteristic inferior, but cost may also increase.

The ratio of the weight-average molecular weight and PSSI of the viscosity index improver ($M_W$/PSSI) is preferably $0.3\times10^4$ or greater, more preferably $0.5\times10^4$ or greater, even more preferably $0.7\times10^4$ or greater and most preferably $1\times10^4$ or greater. If the $M_W$/PSSI ratio is less than $0.3\times10^4$, the fuel efficiency and cold-start property, i.e. the viscosity-temperature characteristic and low-temperature viscosity characteristic, may be impaired.

The ratio between the weight-average molecular weight ($M_W$) and number-average molecular weight ($M_N$) of the viscosity index improver ($M_W/M_N$) is preferably no greater than 5.0, more preferably no greater than 4.0, even more preferably no greater than 3.5 and most preferably no greater than 3.0. Also, $M_W/M_N$ is preferably 1.0 or greater, more preferably 2.0 or greater, even more preferably 2.5 or greater and most preferably 2.6 or greater. If $M_W/M_N$ is greater than 4.0 or less than 1.0, the improving effect on the solubility and viscosity-temperature characteristic will be impaired, potentially making it impossible to maintain sufficient storage stability or fuel efficiency.

The viscosity index improver is not particularly limited so long as it satisfies the aforementioned conditions for the A/B ratio and C/B ratio of the thickening effects. Examples include non-dispersed or dispersed poly(meth)acrylates, styrene-diene hydrogenated copolymers, non-dispersed or dispersed ethylene-α-olefin copolymers or their hydrogenated forms, polyisobutylene or its hydrogenated form, styrene-maleic anhydride ester copolymers, polyalkylstyrenes and (meth)acrylate-olefin copolymers, as well as mixtures of the foregoing, that satisfy the aforementioned conditions for the A/B ratio and C/B ratio of the thickening effects.

A poly(meth)acrylate-based compound to be used as the viscosity index improver (here, "poly(meth)acrylate-based compound" collectively includes polyacrylate-based compounds and polymethacrylate-based compounds) is preferably a polymer of polymerizable monomers that include (meth)acrylate monomers represented by the following formula (5) (hereunder referred to as "monomer M-1").

[Chemical Formula 1]

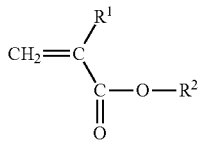

(5)

[In formula (5), $R^1$ represents hydrogen or methyl, and $R^2$ represents a C1-200 straight-chain or branched hydrocarbon group.]

A poly(meth)acrylate-based compound obtained by polymerization of a homopolymer of one monomer represented by formula (5) or copolymerization two or more thereof is a "non-dispersed poly(meth)acrylate", but the poly(meth)acrylate-based compound of the invention may also be a "dispersed poly(meth)acrylate" in which a monomer represented by formula (5) is copolymerized with one or more monomers selected from among the following formulas (6) and (7) (hereunder referred to as "monomer M-2" and "monomer M-3", respectively).

[Chemical Formula 2]

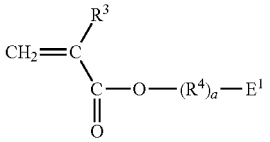

(6)

[In general formula (6), $R^3$ represents hydrogen or methyl, $R^4$ represents a C1-18 alkylene group, $E^1$ represents an amine residue or heterocyclic residue containing 1-2 nitrogen atoms and 0-2 oxygen atoms, and a is 0 or 1.]

[Chemical Formula 3]

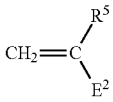

(7)

[In general formula (7), $R^5$ represents hydrogen or methyl and $E^2$ represents an amine residue or heterocyclic residue containing 1-2 nitrogen atoms and 0-2 oxygen atoms.]

Specific examples of groups represented by $E^1$ and $E^2$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomer M-2 and monomer M-3 include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

There are no particular restrictions on the molar ratio of copolymerization in the copolymer of monomer M-1 and monomers M-2 and M-3, but preferably it is a ratio of approximately M-1:M-2-M-3=99:1-80:20, more preferably 98:2-85:15 and even more preferably 95:5-90:10.

The weight-average molecular weight ($M_W$) of the poly (meth)acrylate-based compound is preferably 5000 or greater, more preferably 10,000 or greater, even more preferably 20,000 or greater and most preferably 50,000 or greater. It is also preferably no greater than 700,000, more preferably no greater than 500,000, even more preferably no greater than 200,000 and most preferably no greater than 100,000. If the weight-average molecular weight is less than 5000, the effect of improving the viscosity index, when it is dissolved in the lubricating base oil, will be minimal, not only resulting in inferior fuel efficiency and low-temperature viscosity characteristics but also potentially increasing cost, while if the weight-average molecular weight is greater than 1,000,000 the shear stability, solubility in the lubricating base oil and storage stability may be impaired.

The styrene-diene hydrogenated copolymer that may be used as viscosity index improver is a compound comprising a hydrogenated copolymer of styrene and a diene. Specifically, butadienes, isoprenes and the like may be used as dienes. Particularly preferred are hydrogenated copolymers of styrene and isoprene.

The weight-average molecular weight ($M_W$) of the styrene-diene hydrogenated copolymer is preferably 5000 or greater, more preferably 10,000 or greater and even more preferably 15,000 or greater. It is also preferably no greater than 100,000, more preferably no greater than 80,000 and even more preferably no greater than 70,000. If the weight-average molecular weight is less than 5000, the effect of improving the viscosity index, when it is dissolved in the lubricating base oil, will be minimal, not only resulting in inferior fuel efficiency and low-temperature viscosity characteristics but also potentially increasing cost, while if the weight-average molecular weight is greater than 100,000 the shear stability, solubility in the lubricating base oil and storage stability may be impaired.

The ethylene-α-olefin copolymer or its hydrogenated form, to be used as viscosity index improver, is a copolymer of ethylene and an α-olefin, or a hydrogenated form of the copolymer. Specifically, propylene, isobutylene, 1-butene, 1-pentene, 1-hexene, 1-octene, 1-decene, 1-decene and the like may be used as α-olefins. The ethylene-α-olefin copolymer may be a non-dispersed type consisting of only hydrocarbons, or it may be a dispersed ethylene-α-olefin copolymer wherein a polar compound such as a nitrogen-containing compound has been reacted with a copolymer.

The weight-average molecular weight ($M_W$) of the ethylene-α-olefin copolymer or its hydrogenated form is preferably 5,000 or greater, more preferably 10,000 or greater and even more preferably 30,000 or greater. It is also preferably no greater than 500,000, more preferably no greater than 400,000 and even more preferably no greater than 300,000. If the weight-average molecular weight is less than 5,000, the effect of improving the viscosity index, when it is dissolved in the lubricating base oil, will be minimal, not only resulting in inferior fuel efficiency and low-temperature viscosity characteristics but also potentially increasing cost, while if the weight-average molecular weight is greater than 500,000 the shear stability, solubility in the lubricating base oil and storage stability may be impaired.

The viscosity index improver used in the lubricating oil composition of the invention is preferably poly(meth)acrylate.

The viscosity index improver content of the lubricating oil composition of the invention is preferably 0.1-15.0% by mass, more preferably 0.5-14.0% by mass, even more preferably 1.0-13.0% by mass and most preferably 1.5-12.0% by mass, based on the total weight of the composition. If the content is less than 0.1% by mass the low-temperature characteristics may be inadequate, while if the content is greater than 15.0% by mass the shear stability of the composition may be impaired.

The lubricating oil composition of the invention may also contain a friction modifier selected from among organic molybdenum compounds and ash-free friction modifiers, in order to increase the fuel efficiency performance.

The organic molybdenum compound used for the invention may be a sulfur-containing organic molybdenum compound such as molybdenum dithiophosphate or molybdenum dithiocarbamate.

When an organic molybdenum compound is used in the lubricating oil composition of the invention, there are no particular restrictions on the content, but it is preferably 0.001% by mass or greater, more preferably 0.005% by mass or greater, even more preferably 0.01% by mass or greater and most preferably 0.02% by mass or greater, and also preferably no greater than 0.2% by mass, more preferably no greater than 0.1% by mass and most preferably no greater than 0.07% by mass, in terms of molybdenum element based on the total weight of the composition. If the content is less than 0.001% by mass, the friction reducing effect will tend to be insufficient. On the other hand, if the content is greater than 0.2% by mass the effect will not be commensurate with the increased amount, and the storage stability of the lubricating oil composition will tend to be reduced.

The ash-free friction modifier used for the invention may be any compound commonly used as a friction modifier for lubricating oils, and as examples there may be mentioned ash-free friction modifiers that are amine compounds, fatty acid esters, fatty acid amides, fatty acids, aliphatic alcohols, aliphatic ethers and the like having one or more C6-30 alkyl or alkenyl and especially C6-30 straight-chain alkyl or straight-chain alkenyl groups in the molecule. There may also be mentioned one or more compounds selected from the group consisting of nitrogen-containing compounds represented by the following formulas (8) and (9) and their acid-modified derivatives, and the ash-free friction modifiers mentioned in International Patent Publication No. WO2005/037967.

[Chemical Formula 4]

(8)

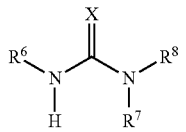

[In formula (8), $R^6$ is a C1-30 hydrocarbon or functional C1-30 hydrocarbon group, preferably a C10-30 hydrocarbon or a functional C10-30 hydrocarbon, more preferably a C12-20 alkyl, alkenyl or functional hydrocarbon group and most preferably a C12-20 alkenyl group, $R^7$ and $R^8$ are each a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen and even more preferably hydrogen, and X is oxygen or sulfur and preferably oxygen.]

[Chemical Formula 5]

(9)

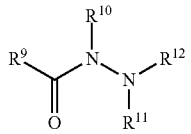

[In formula (9), $R^9$ is a C1-30 hydrocarbon or functional C1-30 hydrocarbon group, preferably a C10-30 hydrocarbon or a functional C10-30 hydrocarbon, more preferably a C12-20 alkyl, alkenyl or functional hydrocarbon group and most preferably a C12-20 alkenyl group, $R^{10}$, $R^{11}$ and $R^{12}$ are each independently a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen, and even more preferably hydrogen.]

Nitrogen-containing compounds represented by formula (8) include, specifically, hydrazides with C1-30 hydrocarbon or functional C1-30 hydrocarbon groups, and their derivatives. When $R^9$ is a C1-30 hydrocarbon or functional C1-30 hydrocarbon group and $R^{10}$-$R^{12}$ are hydrogen, they are hydrazides containing a C1-30 hydrocarbon group or functional C1-30 hydrocarbon group, and when any of $R^9$ and $R^{10}$-$R^{12}$ is a C1-30 hydrocarbon group or functional C1-30 hydrocarbon group and the remaining $R^{10}$-$R^{12}$ groups are hydrogen, they are N-hydrocarbyl hydrazides containing a C1-30 hydrocarbon group or functional C1-30 hydrocarbon group (the hydrocarbyl being a hydrocarbon group or the like).

When an ash-free friction modifier is used in the lubricating oil composition of the invention, the ash-free friction modifier content is preferably 0.01% by mass or greater, more preferably 0.1% by mass or greater and even more preferably 0.3% by mass or greater, and preferably no greater than 3% by mass, more preferably no greater than 2% by mass and even more preferably no greater than 1% by mass, based on the total weight of the composition. If the ash-free friction modifier content is less than 0.01% by mass the friction reducing effect by the addition will tend to be insufficient, while if it is greater than 3% by mass, the effects of the wear resistance additives may be inhibited, or the solubility of the additives may be reduced.

According to the invention, either an organic molybdenum compound or an ash-free friction modifier may be used alone or both may be used together, but it is more preferred to use an organic molybdenum compound.

The lubricating oil composition of the invention may further contain any additives commonly used in lubricating oils, for the purpose of enhancing performance. Examples of such additives include additives such as metal cleaning agents, non-ash powders, antioxidants, anti-wear agents (or extreme-pressure agents), corrosion inhibitors, rust-preventive agents, pour point depressants, demulsifiers, metal inactivating agents and antifoaming agents.

Metal cleaning agents include normal salts, basic normal salts and overbased salts such as alkali metal sulfonates or alkaline earth metal sulfonates, alkali metal phenates or alkaline earth metal phenates, and alkali metal salicylates or alkaline earth metal salicylates. According to the invention, it is preferred to use one or more alkali metal or alkaline earth metal cleaning agents selected from the group consisting of those mentioned above, and especially an alkaline earth metal cleaning agent. Preferred are magnesium salts and/or calcium salts, with calcium salts being particularly preferred.

As non-ash powders there may be used any non-ash powders used in lubricating oils, examples of which include mono- or bis-succinic acid imides with at least one C40-400 straight-chain or branched alkyl group or alkenyl group in the molecule, benzylamines with at least one C40-400 alkyl group or alkenyl group in the molecule, polyamines with at least one C40-400 alkyl group or alkenyl group in the molecule, and modified forms of the foregoing with boron compounds, carboxylic acids, phosphoric acids and the like. One or more selected from among any of the above may be added for use.

As antioxidants there may be mentioned phenol-based and amine-based ash-free antioxidants, and copper-based or molybdenum-based metal antioxidants. Specific examples include phenol-based ash-free antioxidants such as 4,4'-methylenebis(2,6-di-tert-butylphenol) and 4,4'-bis(2,6-di-tert-butylphenol), and amine-based ash-free antioxidants such as phenyl-α-naphthylamine, alkylphenyl-α-naphthylamine and dialkyldiphenylamine.

As anti-wear agents (or extreme-pressure agents) there may be used any anti-wear agents and extreme-pressure agents that are utilized in lubricating oils. For example, sulfur-based, phosphorus-based and sulfur/phosphorus-based extreme-pressure agents may be used, specific examples of which include phosphorous acid esters, thiophosphorous acid esters, dithiophosphorous acid esters, trithiophosphorous acid esters, phosphoric acid esters, thiophosphoric acid esters, dithiophosphoric acid esters and trithiophosphoric acid esters, as well as their amine salts, metal salts and their derivatives, dithiocarbamates, zinc dithiocarbamate, molybdenum dithiocarbamate, disulfides, polysulfides, olefin sulfides, sulfurized fats and oils, and the like. Sulfur-based extreme-pressure agents, and especially sulfurized fats and oils, are preferably added.

Examples of corrosion inhibitors include benzotriazole-based, tolyltriazole-based, thiadiazole-based and imidazole-based compounds.

Examples of rust-preventive agents include petroleum sulfonates, alkylbenzene sulfonates, dinonylnaphthalene sulfonates, alkenylsuccinic acid esters and polyhydric alcohol esters.

Examples of pour point depressants that may be used include polymethacrylate-based polymers suitable for the lubricating base oil used.

Examples of demulsifiers include polyalkylene glycol-based nonionic surfactants such as polyoxyethylenealkyl ethers, polyoxyethylenealkylphenyl ethers and polyoxyethylenealkylnaphthyl ethers.

Examples of metal inactivating agents include imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

Examples of antifoaming agents include silicone oils, alkenylsuccinic acid derivatives, polyhydroxyaliphatic alcohol and long-chain fatty acid esters, methyl salicylate and o-hydroxybenzyl alcohols, which have kinematic viscosities at 25° C. of 1000-100,000 $mm^2/S$.

When such additives are added to a lubricating oil composition of the invention, their contents are 0.01-10% by mass based on the total weight of the composition.

The kinematic viscosity at 100° C. of the lubricating oil composition of the invention is preferably 5.6-9.0 $mm^2/s$, more preferably 6.0 $mm^2/s$ or greater and even more preferably 6.5 $mm^2/s$ or greater. The kinematic viscosity at 100° C. of the lubricating oil composition of the invention is also preferably no greater than 8.5 $mm^2/s$ and more preferably no greater than 8.0 $mm^2/s$. If the kinematic viscosity at 100° C. is less than 5.6 $mm^2/s$, insufficient lubricity may result, and if it is greater than 9.0 $mm^2/s$ it may not be possible to obtain the necessary low-temperature viscosity and sufficient fuel efficiency performance.

The kinematic viscosity at 40° C. of the lubricating oil composition of the invention is preferably 20-32 $mm^2/s$, more preferably 22-31 $mm^2/s$ and even more preferably 24-30 $mm^2/s$. If the kinematic viscosity at 40° C. is less than 20 $mm^2/s$, insufficient lubricity may result, and if it is greater than 32 $mm^2/s$ it may not be possible to obtain the necessary low-temperature viscosity and sufficient fuel efficiency performance.

The viscosity index of the lubricating oil composition of the invention is preferably in the range of 140-350, and the lower limit is preferably 150 or greater, even more preferably 160 or greater and yet more preferably 170 or greater. The upper limit is preferably no greater than 300, even more preferably no greater than 285 and most preferably no greater than 270. If the viscosity index of the lubricating oil composition of the invention is less than 140 it may be difficult to maintain the HTHS viscosity at 150° C. while improving fuel efficiency, and it may also be difficult to lower the low-temperature viscosity at −30° C. and below. In addition, if the viscosity index of the lubricating oil composition of the invention is greater than 350, the low-temperature flow property may be poor and problems may occur due to solubility of the additives or lack of compatibility with the sealant material.

The HTHS viscosity at 150° C. of the lubricating oil composition of the invention is preferably 2.45 Pa·s or greater, more preferably 2.50 mPa·s or greater and even more preferably 2.55 mPa·s or greater. The HTHS viscosity at 150° C. of the lubricating oil composition of the invention is also preferably no greater than 3.2 mPa·s, more preferably no greater than 3.1 mPa·s, even more preferably no greater than 3.0 mPa·s and most preferably no greater than 2.9 mPa·s. If the HTHS viscosity at 150° C. is less than 2.5 mPa·s, insufficient lubricity may result, and if it is greater than 3.2 mPa·s it may not be possible to obtain the necessary low-temperature viscosity and sufficient fuel efficiency performance.

The HTHS viscosity at 100° C. of the lubricating oil composition of the invention is preferably 3.0 mPa·s or greater, more preferably 3.5 mPa·s or greater, even more preferably 4.0 mPa·s or greater and most preferably 4.5 mPa·s or greater. The HTHS viscosity at 100° C. of the lubricating oil composition of the invention is also preferably no greater than 8.0 mPa·s, more preferably no greater than 7.5 mPa·s, even more preferably no greater than 7.0 mPa·s and most preferably no greater than 6.0 mPa·s. If the HTHS viscosity at 100° C. is less than 3.0 mPa·s, insufficient lubricity may result, and if it is greater than 8.0 mPa·s it may not be possible to obtain the necessary low-temperature viscosity and sufficient fuel efficiency performance.

Also, the ratio of the HTHS viscosity at 150° C. and the HTHS viscosity at 100° C. of the lubricating oil composition of the invention (HTHS viscosity at 150° C./HTHS viscosity at 100° C.) is preferably 0.50 or greater, more preferably 0.51 or greater, even more preferably 0.52 or greater and most preferably 0.53 or greater. If the ratio is less than 0.50, the viscosity-temperature characteristic will be impaired, potentially making it impossible to obtain sufficient fuel efficiency performance.

The lubricating oil composition of the invention has excellent fuel efficiency and low-temperature viscosity, and is effective for improving fuel efficiency while maintaining a constant level for the HTHS viscosity at 150° C., even without using a synthetic oil such as a poly-α-olefinic base oil or esteric base oil or a low-viscosity mineral base oil, and for reducing the kinematic viscosities at 40° C. and 100° C. and the HTHS viscosity at 100° C. of lubricating oils. The lubricating oil composition of the invention having such superior properties can be suitably employed as a fuel efficient engine oil, such as a fuel efficient gasoline engine oil or fuel efficient diesel engine oil.

EXAMPLES

The present invention will now be explained in greater detail based on examples and comparative examples, with the understanding that these examples are in no way limitative on the invention.

Examples 1-2, Comparative Examples 1-2

For Examples 1-2 and Comparative Examples 1-2, lubricating oil compositions were prepared using the base oils and additives listed below. The properties of the base oil X are shown in Table 1. Also, Table 2 shows the kinematic viscosity at 40° C., kinematic viscosity at 100° C., viscosity index, HTHS viscosity at 100° C., HTHS viscosity at 150° C., thickening effects A-D and their ratios A/B, C/B and D/B, obtained for a mixture of each viscosity index improver added to the base oil X at 3.0% by mass based on the total weight of the mixture. Table 4 shows the compositions and properties (the kinematic viscosities at 40° C. and 100° C., the viscosity index, and the HTHS viscosities at 100° C. and 150° C.) of the lubricating oil compositions of Examples 1-2 and Comparative Examples 1-2.

(Base Oils)

Base oil X: Wax isomerized base oil produced by wax isomerization.

(Viscosity Index Improver)

PMA-1: Non-dispersed polymethacrylate (weight-average molecular weight=380,000, PSSI=27, Mw/PSSI=$1.41\times10^4$)

PMA-2: Non-dispersed polymethacrylate (weight-average molecular weight=414,000, PSSI=4, Mw/PSSI=$10.35\times10^4$)

PMA-3: Non-dispersed polymethacrylate (weight-average molecular weight=30,000, PSSI=5, Mw/PSSI=$0.6\times10^4$)

PMA-4: Non-dispersed polymethacrylate (weight-average molecular weight=300,000, PSSI=28, Mw/PSSI=$1.09\times10^4$)

(Other Additives)

B: Performance additive package (containing metal cleaning agent, non-ash powder, antioxidant, phosphorus-based anti-wear agent, friction modifier and antifoaming agent)

Example 3, Comparative Example 3

For Example 3 and Comparative Example 3 there were prepared lubricating oil compositions using the additives listed below with YUBASE-4 by SK Energy Co., Ltd., listed in Table 1. Also, Table 3 shows the kinematic viscosity at 40° C., kinematic viscosity at 100° C., viscosity index, HTHS viscosity at 100° C., HTHS viscosity at 150° C., thickening effects A-D and their ratios A/B, CM and D/B, obtained for a mixture of each viscosity index improver added to YUBASE-4 at 3.0% by mass based on the total weight of the mixture. Table 4 shows the compositions and properties (the kinematic viscosities at 40° C. and 100° C., the viscosity index, and the HTHS viscosities at 100° C. and 150° C.) of the lubricating oil compositions of Example 3 and Comparative Example 3.

(Viscosity Index Improver)

PMA-1: Same as above.

PMA-5: Dispersed polymethacrylate (weight-average molecular weight=290,000, PSSI=40, Mw/PSSI=$0.73\times10^4$)

(Other Additives)

C: Performance additive package (containing metal cleaning agent, non-ash powder, antioxidant, phosphorus-based anti-wear agent, friction modifier and antifoaming agent)

[Engine Motoring Test]

An engine motoring test was conducted under the following conditions, and the friction torque was measured to evaluate the reduction rate. The results are shown in Table 4.

Engine used: 2400 cc DOHC roller valvetrain system, by Mitsubishi Motors

Rotation speed: 1000-3000 rpm

Oil temperature: 60, 80, 95° C.

Evaluation: Represented as reduction in friction torque (units: %) with Comparative Example 2 as the standard oil.

TABLE 1

| | | | Base oil X | YUBASE 4 |
|---|---|---|---|---|
| Density (15° C.) | | g/cm$^3$ | 0.820 | 0.834 |
| Kinematic viscosity (40° C.) | | mm$^2$/s | 15.8 | 19.9 |
| Kinematic viscosity (100° C.) | | mm$^2$/s | 3.854 | 4.31 |
| Viscosity index | | | 141 | 125 |
| HTHS viscosity (100° C.) | | mPa · s | 2.9 | 3.3 |
| HTHS viscosity (150° C.) | | mPa · s | 1.5 | 1.7 |
| Flow point | | ° C. | −22.5 | −12.5 |
| Aniline point | | ° C. | 118.5 | 116.6 |
| Iodine value | | | 0.06 | 0.05 |
| Sulfur content | | ppm by mass | <1 | <1 |
| Nitrogen content | | ppm by mass | <3 | <10 |
| n-d-M analysis | % CP | | 93.3 | 80.7 |
| | % CN | | 6.7 | 19.3 |
| | % CA | | 0 | 0 |
| Chromatographic separation | Saturated | % by mass | 99.6 | 99.7 |
| | Aromatic | % by mass | 0.2 | 0.2 |
| | Resin | % by mass | 0.1 | 0.1 |
| | Yield | % by mass | 99.9 | 100 |
| Paraffin content based on saturated portion | | % by mass | 87.1 | 53.8 |
| Naphthene content based on saturated portion | | % by mass | 12.9 | 46.2 |

TABLE 2

| Base oil | | Units | Base oil X | | | |
|---|---|---|---|---|---|---|
| Viscosity index improver | Type | | PMA-1 | PMA-2 | PMA-3 | PMA-4 |
| | Amount | % by mass | 3.0 | 3.0 | 3.0 | 3.0 |
| Kinematic viscosity thickening effect A (100° C.) | | mm$^2$/s/1% | 0.18 | 0.34 | 0.37 | 0.62 |
| Kinematic viscosity thickening effect D (40° C.) | | mm$^2$/s/1% | 0.41 | 0.52 | 1.68 | 2.05 |
| HTHS viscosity thickening effect C (100° C.) | | mPa · s/1% | 0.06 | 0.15 | 0.22 | 0.24 |
| HTHS viscosity thickening effect B (150° C.) | | mPa · s/1% | 0.06 | 0.12 | 0.11 | 0.13 |
| A/B | | | 3.0 | 2.8 | 3.4 | 4.8 |
| D/B | | | 6.8 | 4.3 | 15.3 | 15.8 |
| C/B | | | 1.0 | 1.3 | 2.0 | 1.8 |

TABLE 3

| Base oil | | Units | YUBASE 4 | |
|---|---|---|---|---|
| Viscosity index improver | Type | | PMA-1 | PMA-5 |
| | Amount | % by mass | 3.0 | 3.0 |
| Kinematic viscosity thickening effect A (100° C.) | | mm$^2$/s/1% | 0.22 | 0.57 |
| Kinematic viscosity thickening effect D (40° C.) | | mm$^2$/s/1% | 0.56 | 1.82 |
| HTHS viscosity thickening effect C (100° C.) | | mPa · s/1% | 0.06 | 0.21 |
| HTHS viscosity thickening effect B (150° C.) | | mPa · s/1% | 0.06 | 0.1 |
| A/B | | | 3.7 | 5.7 |
| D/B | | | 9.3 | 18.2 |
| C/B | | | 1.0 | 2.1 |

TABLE 4

| | | Example 1 | Example 2 | Comp. Ex. 1 | Comp. Ex. 2 | Example 3 | Comp. Ex. 3 |
|---|---|---|---|---|---|---|---|
| Lubricating base oil | | | | | | | |
| Base oil X | | Remainder | Remainder | Remainder | Remainder | | |
| YUBASE 4 | | | | | | Remainder | Remainder |
| Additives (based on total composition, % by mass) | | | | | | | |
| PMA-1 | | 10.70 | | | | 11.80 | |
| PMA-2 | | | 5.30 | | | | |
| PMA-3 | | | | 6.00 | | | |
| PMA-4 | | | | | 5.00 | | |
| PMA-5 | | | | | | | 6.00 |
| Performance additive B | | 11.10 | 11.10 | 11.10 | 11.10 | | |
| Performance additive C | | | | | | 9.90 | 9.90 |
| Properties of lubriricating oil composition | | | | | | | |
| Kinematic viscosity | 40° C. $mm^2/s$ | 29.41 | 25.90 | 33.96 | 35.15 | 34.09 | 39.90 |
| | 100° C. $mm^2/s$ | 7.47 | 7.10 | 7.58 | 8.54 | 7.93 | 8.50 |
| Viscosity index | | 239 | 260 | 202 | 234 | 216 | 197 |
| HTHS viscosity | 100° C. mPa · s | 4.80 | 4.82 | 5.36 | 5.34 | 5.06 | 5.50 |
| | 150° C. mPa · s | 2.6 | 2.6 | 2.6 | 2.6 | 2.6 | 2.6 |
| HTHS viscosity ratio (150° C./100° C.) | | 0.54 | 0.54 | 0.49 | 0.49 | 0.52 | 0.48 |
| Motoring torque test results | | | | | | | |
| Frictional torque improvement | % | 2.7 | 2.7 | −0.1 | 0.0 | 2.7 | 0.0 |

The results shown in Table 4 indicate that the lubricating oil compositions of Examples 1 and 2, which employed a combination of base oil X and a viscosity index improver satisfying the conditions for the thickening effect ratios A/B and C/B, had notably improved friction torque in the motoring friction torque test, compared to Comparative Examples 1 and 2 which employed viscosity index improvers that did not satisfy these conditions. It is also seen that the lubricating oil composition of Example 3, which employed a combination of YUBASE-4 and a viscosity index improver satisfying the conditions for the thickening effect ratios A/B and C/B, had notably improved friction torque in the motoring friction torque test, compared to Comparative Example 3 which employed a viscosity index improver that did not satisfy these conditions.

The invention claimed is:

1. A lubricating oil composition comprising:

a lubricating base oil having a kinematic viscosity at 100° C. of 1-6 $mm^2/s$, a % $C_p$ value of 70 or greater and a % $C_A$ value of no greater than 2, and a viscosity index improver which, when added to the lubricating base oil, results in an A/B ratio of less than 3.2 between the thickening effect A on the kinematic viscosity at 100° C. represented by the following formula (1) and the thickening effect B on the HTHS viscosity at 150° C. represented by the following formula (2), and a C/B ratio of less than 1.5 between the thickening effect C on the HTHS viscosity at 100° C. represented by the following formula (3) and the thickening effect B on the HTHS viscosity at 150° C. represented by the following formula (2):

$$A=X-X_0 \quad (1)$$

wherein A represents the thickening effect on the kinematic viscosity at 100° C., X represents the kinematic viscosity at 100° C. by $mm^2/s$ of a mixture of the lubricating base oil and the viscosity index improver at 3% by mass, and $X_0$ represents the kinematic viscosity at 100° C. by $mm^2/s$ of the lubricating base oil, $$B=Y-Y_0 \quad (2)$$

wherein B represents the thickening effect on the HTHS viscosity at 150° C., Y represents the HTHS viscosity at 150° C. by mPa·s of a mixture of the lubricating base oil and the viscosity index improver at 3% by mass, and $Y_0$ represents the HTHS viscosity at 150° C. by mPa·s of the lubricating base oil, $$C=Z-Z_0 \quad (3)$$

wherein C represents the thickening effect on the HTHS viscosity at 100° C., Z represents the HTHS viscosity at 100° C. by mPa·s of a mixture of the lubricating base oil and the viscosity index improver at 3% by mass, and $Z_0$ represents the HTHS viscosity at 100° C. by mPa·s of the lubricating base oil.

2. A lubricating oil composition according to claim 1, wherein the viscosity index improver is a viscosity index improver having a D/B ratio of less than 10, between the thickening effect D on the kinematic viscosity at 40° C. represented by the following formula (4) and the thickening effect B on the HTHS viscosity at 150° C. represented by formula (2) above, $$D=W-W_0 \quad (4)$$

wherein D represents the thickening effect on the 40° C. kinematic viscosity, W represents the kinematic viscosity at 40° C. by $mm^2/s$ of a mixture of the lubricating base oil and the viscosity index improver at 3% by mass, and $W_0$ represents the kinematic viscosity at 40° C. by $mm^2/s$ of the lubricating base oil.

3. A lubricating oil composition according to claim 1, wherein the viscosity index improver is a polymethacrylate with a PSSI of no greater than 30.

4. A lubricating oil composition according to claim 1, which has a kinematic viscosity at 100° C. of 5.6-9 $mm^2/s$, a HTHS viscosity at 150° C. of 2.6-2.9 mPa·s and a viscosity index of 150 or greater.

5. A lubricating oil composition according to claim 1, wherein the ratio of the HTHS viscosity at 150° C. and the HTHS viscosity at 100° C. of the lubricating oil composition is 0.50.

* * * * *